US011213115B1

(12) United States Patent
Flynn

(10) Patent No.: US 11,213,115 B1
(45) Date of Patent: Jan. 4, 2022

(54) HOLSTER FOR ELONGATED ARTICLES

(71) Applicant: Raymond G. Flynn, Jenkintown, PA (US)

(72) Inventor: Raymond G. Flynn, Jenkintown, PA (US)

( * ) Notice: Subject to any disclaimer, the term of this patent is extended or adjusted under 35 U.S.C. 154(b) by 0 days.

(21) Appl. No.: 17/060,185

(22) Filed: Oct. 1, 2020

Related U.S. Application Data

(63) Continuation-in-part of application No. 16/936,535, filed on Jul. 23, 2020.

(51) Int. Cl.
*A45F 5/02* (2006.01)

(52) U.S. Cl.
CPC ..... *A45F 5/021* (2013.01); *A45F 2200/0566* (2013.01); *A45F 2200/0575* (2013.01)

(58) Field of Classification Search
CPC ..... A45F 2200/056; A45F 2200/0575; A45F 5/02; A45F 5/021; A45F 3/005; Y10T 24/1388; A45C 1/04; B25H 3/006; Y10S 224/904; Y10S 224/914; A63B 47/001; A63B 57/20
USPC ..... 224/251, 677, 200, 671, 673, 675, 904, 224/148.4, 234, 931, 232; 24/3.1, 11 PP, 24/11 CC, 11 CT, 11 HC
See application file for complete search history.

(56) References Cited

U.S. PATENT DOCUMENTS

| | | | | |
|---|---|---|---|---|
| 3,970,228 | A | 7/1976 | Keller | |
| D293,628 | S | 1/1988 | Teachey | |
| 4,970,631 | A | 11/1990 | Marshall | |
| 5,104,076 | A | 4/1992 | Goodall, Jr. | |
| 5,465,889 | A * | 11/1995 | Smith | A45F 3/00 224/235 |
| 5,752,633 | A | 5/1998 | Antaki | |
| 6,357,586 | B2 * | 3/2002 | Pratt | A63B 55/20 206/315.9 |
| 7,389,899 | B2 | 6/2008 | Johnson | |
| 7,913,840 | B2 * | 3/2011 | Kealy | A63B 55/408 206/315.9 |
| 10,145,044 | B2 * | 12/2018 | Schenk | A45C 3/00 |
| 2006/0037982 | A1 * | 2/2006 | Lesser | A45F 5/021 224/148.4 |

* cited by examiner

*Primary Examiner* — Adam J Waggenspack
(74) *Attorney, Agent, or Firm* — Howson & Howson LLP

(57) ABSTRACT

A holster comprises an elongated flexible fabric tube woven from fusible yarns. A first part of the tube has a passage for receiving a waist belt. A second part of the tube extends from the first part transverse to the direction of the waist belt-receiving passage, and an opening in the second part enables the second part to serve as a pocket for receiving and holding an elongated article. The waist belt-receiving passage can be formed by opposed elongated openings in the wall of the tube. Alternatively, the waist belt-receiving passage can be formed by bending the tube to form a loop. In the latter case, a portion the tube extends from the loop, through an opening, into the interior of tube and then outward from an open end of the first part. Here, the outwardly extending portion of tube is the second part, and serves as the pocket.

6 Claims, 8 Drawing Sheets

HOLSTER FOR ELONGATED ARTICLES

CROSS-REFERENCE TO RELATED APPLICATION

This is a continuation-in-part of application Ser. No. 16/936,535, filed on Jul. 23, 2020. The entire disclosure of application Ser. No. 16/936,535 is incorporated by reference.

FIELD OF THE INVENTION

This invention relates to holsters, and particularly to a holster for carrying elongated articles such as flashlights or adjustable wrenches. It relates particularly to a holster that can be removably attached to an individual's waist belt, and that allows an individual to carry the elongated article securely and to remove it easily from the holster.

BACKGROUND OF THE INVENTION

A typical flashlight of the kind having a generally cylindrical battery compartment and a flared light-emitting bezel at one end of the battery compartment, is shaped in such a way that it is impractical to carry it in a pocket of one's clothing. Especially in the case in which the battery compartment holds two or more type "AA" or type "C" dry cells arranged in end-to-end relationship, the length of the flashlight is such that a large portion of the flashlight extends outward from the pocket, creating a risk that a rapid body movement will cause the flashlight to fall out from the pocket. The presence of a flashlight in a pocket of one's clothing also makes it inconvenient to use the same pocket for other purposes such as carrying a wallet, coins, keys or other articles.

Flashlights can be provided with hooks or clips for attachment to a waist belt, but such hooks and clips that have sufficient flexibility and resilience to serve this purpose adequately are often subject to bending beyond their elastic limits, or even breakage, if the flashlight is pulled outward while hanging from a belt.

Similar problems arise in carrying other elongated devices, such as adjustable wrenches, on the person.

Flashlight holsters current known are typically composed of multiple parts, difficult to manufacture, and expensive.

There has been a need for an inexpensive, convenient, easy-to-use, and durable holster that enables a flashlight or other elongated device to be carried conveniently and securely, and to be removed easily from the holster for use.

SUMMARY OF THE INVENTION

An object of this invention is to provide a holster that satisfies the above-mentioned needs.

The holster in accordance with the invention comprises an elongated tube of fabric having a flexible wall and formed with longitudinal openings that provide a passage for receiving a waist belt, and a transverse opening that enables a second part of the tube to serve as a pocket for receiving a portion of the body of a flashlight, the handle of an adjustable wrench, or a portion of another elongated article.

In one embodiment, the tube is formed with a pair of elongated longitudinal openings in the wall of the tube. These openings extend along opposite sides of the tube from a first location between first and second opposite ends of the tube to a second location between the first location and the second opposite end. The elongated longitudinal openings can receive a waist belt, allowing the holder to be worn on one's hip. A third opening extends tranversely across a part of the tube at a third location between the second location and the second end of the tube. The portion of the tube extending from the third opening to the second end of the tube forms the pocket. The length of the third opening, measured in the transverse direction, is preferably at least approximately one half of the circumference of the elongated tube at the third location so that the third opening can be shaped into a circular opening having a diameter substantially equal to the internal diameter of the tube and capable of receiving the body of an article that closely fits the interior of the tube.

The tube may be closed at least at its second end to limit the movement of a flashlight or other device into the receiving pocket. The closure is preferably formed by fusion of the yarns of the tube to one another at the location of the second end.

The holster according to the invention can be composed entirely of a woven fabric, preferably a fabric made up of fusible yarns such as nylon or polyester yarns.

The portion of the elongated tube extending from the first end to the first location, i.e., the location of the upper ends of the longitudinal belt openings, the portion extending from the second location, i.e., the location of lower ends of the belt openings to the third opening, and the portion of the tube extending from the third opening to the second end, are preferably constituted by woven portions the weft yarns of which are continuous around the perimeter of the tube. Preferably, the tube is initially a woven tube having a continuous, helical weft yarn. The first, second and third openings are preferably formed by cutting the woven fabric using a heated blade that causes the yarns at the margins of the first, second and third openings in the tube to become fused to one another to prevent fraying.

The third opening can be formed by cutting the fabric tube along a line transverse to the direction of elongation of the tube and having a length approximating one-half the circumference of the tube. Alternatively, the third opening can be formed with opposed concave margins each extending across the part of the elongated tube at the third location. These concave margins can be in the form of 180° circular arcs which together form a circle.

A portion of the elongated tube extending from the first location to the first of the first and second opposite ends, preferably has a length sufficient to allow the tube to be folded at a location adjacent the first location so that the portion extending from the first location to the first of the first and second opposite ends can be located behind a belt extending through the first and second openings.

In an alternative embodiment, a first part of the elongated tube is bent to form a loop, which provides the passage for the waist belt. In this embodiment, a first part of the elongated tube has an open end and a second opening spaced from the open end. This second opening provides a passage leading from the exterior of the tube to the interior. The loop extends from a location adjacent the second opening, and the the tube continues from the loop into the second opening, through the portion of the tube extending from the second opening to the open end of the first part, and outward from the open end. The part of the tube extending outward from the open end of the first part constitutes the second part of the tube, which serves as the article-receiving pocket.

DETAILED DESCRIPTION OF THE PREFERRED EMBODIMENTS

Figure 1:
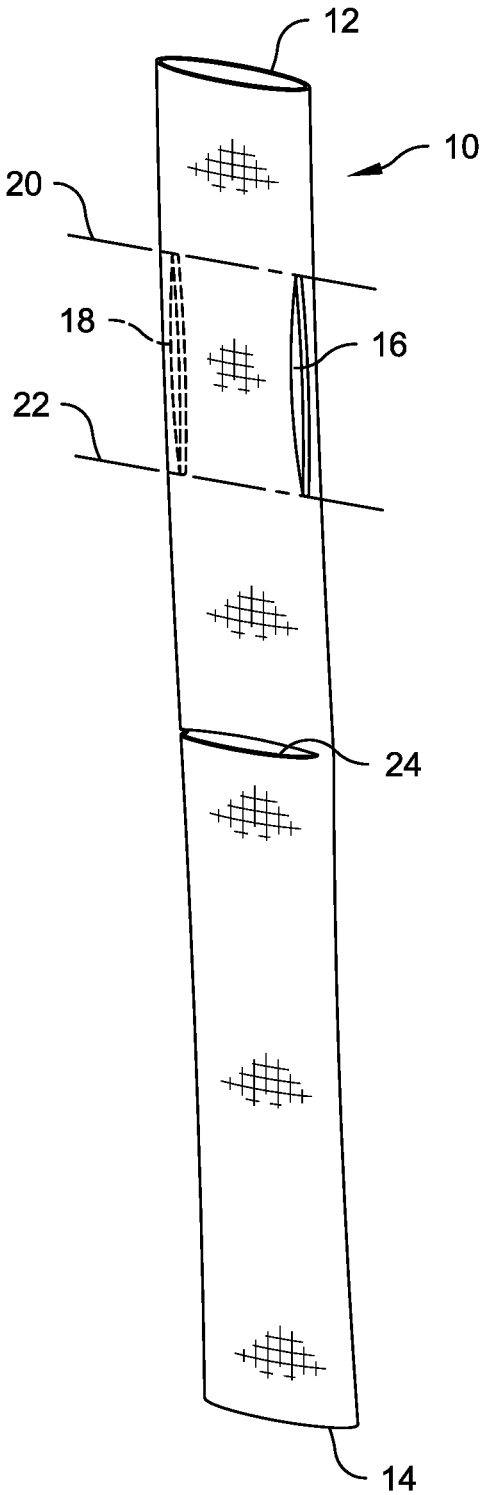
FIG. 1 is a perspective view of a first embodiment of a holster in accordance with the invention.

The holster 10 shown in FIG. 1, which is suitable for use with a flashlight, is composed, substantially entirely, of a flexible elongated tube of fabric, preferably a fabric formed by weaving yarns of a fusible polymer such as nylon or polyester. The tube can be composed of one or more sheets of woven fabric formed into a tube with one or more longitudinal seams. Preferably, however, the tube is woven with a continuous helical weft. The use of woven tubing having a continuous weft simplifies the manufacture of the holster by avoiding the need for stitching or adhesives, and also improves its durability.

The tube extends from a first end 12 to a second end 14, and has a pair of elongated openings for receiving a waist belt. A first one of these openings, opening 16, is shown in full view, and the second opening, opening 18, is directly opposite opening 16, and shown by a broken line. These openings extend from a first location, indicated by reference line 20, between ends 12 and 14 of the tube to a second location, indicated by reference line 22, at a second location between the first location and end 14 of the tube. A third opening, opening 24, extends in a direction transverse to the direction of elongation of the tube, across a part of the tube at a third location between the location indicated by reference line 22 and the end 14 of the tube. The length of opening 24 in the direction transverse to the direction of elongation of the tube should be at least approximately one half the circumference of the tube at the location of opening 24, so that, by flexing the material of the tube, an opening having a circumference corresponding to the circumference of the tube can be provided for receiving a flashlight or other article. The length of opening 24 can be, but need not be, greater than one half the circumference of the tube.

Each of the openings is preferably formed by the use of a metal blade heated to a temperature sufficient to melt the woven material. When the heated blade is applied to the material, a protective backing of metal or other suitable material should be in place within the tube to prevent the heated blade from opening or damaging other parts of the tube. The heat of the blade not only forms the openings, but also fuses yarns at the margin of each opening to one another so that fraying at the margins is avoided. The lower end 14 of the tube may also be closed by the application of heat to cause opposite sides of the lower end opening to be fused together.

Figure 2:
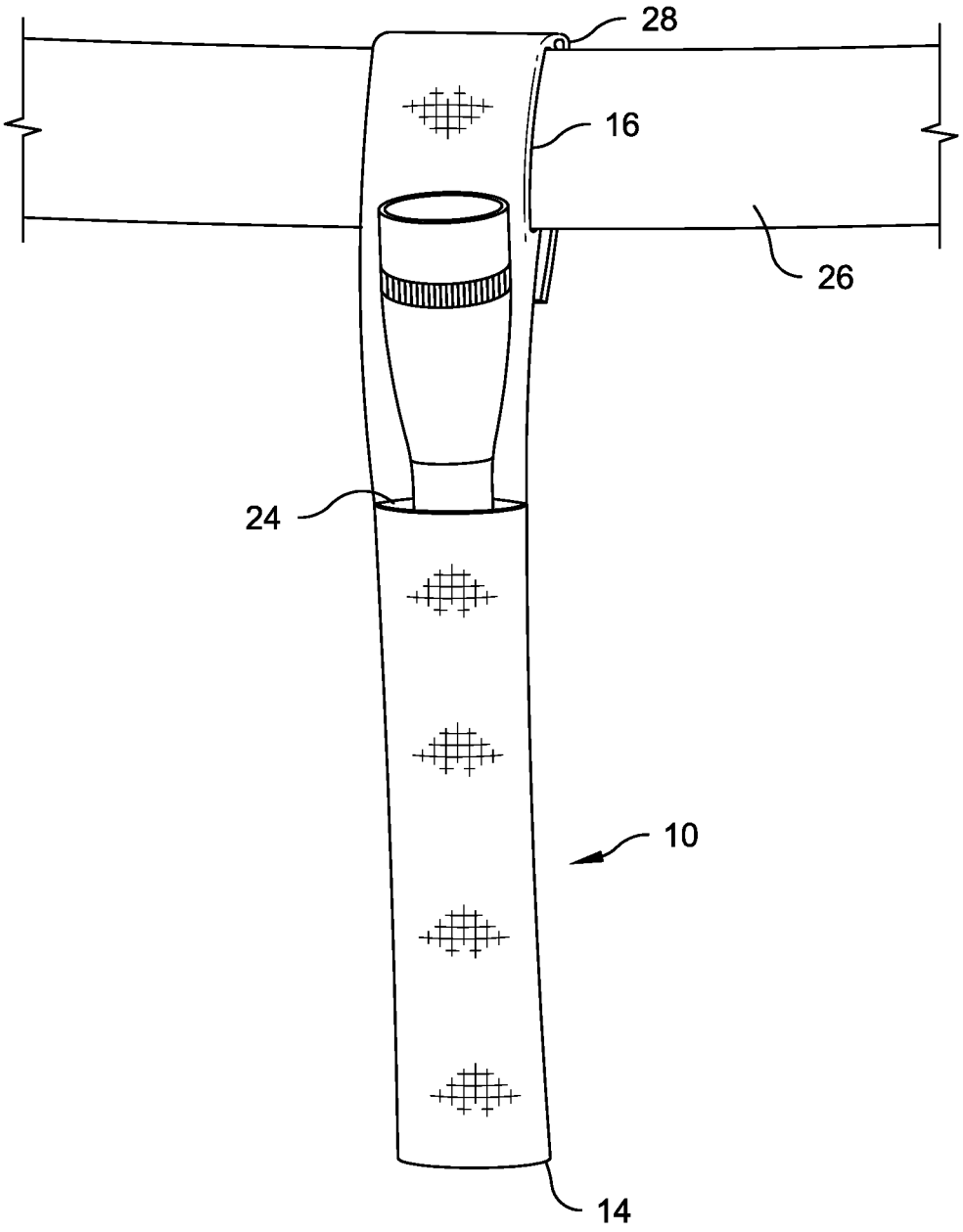
FIG. 2 is a perspective view of the embodiment of FIG. 1 attached to a waist belt and holding a flashlight.

As shown in FIG. 2, the holster 10 is engaged with a waist belt 26, which extends though opening 16 and opening 18 (shown in FIG. 1) to support the holster. A portion 28 of the tube extending from end 12 to a location adjacent the location designated by reference line 20 in FIG. 1, is folded downward behind the section between the locations designated by reference lines 20 and 22, and may be secured to the back side of the tube by fusion in the process of making the holster.

A flashlight 30 can then be inserted into opening 24 so that a major part of the length of its barrel is inside the tube while the bezel of the flashlight is exposed and can be grasped in order to remove the flashlight from the holster. In the embodiment illustrated in FIGS. 1 and 2, the closure at the lower end 14 of the tube supports the flashlight. However, in those cases where the bezel of the flashlight is larger than the barrel, the closure at the lower end 14 is not necessary and the lower end may be left open. The holster can be used to hold a flashlight having a generally cylindrical shape, i.e., a flashlight lacking an enlarged bezel. Such flashlights can be supported by the closure at the lower end of the holster. Some flashlights are provided with a metal clip for engaging the pocket of an article of clothing. The clip can be engaged with the exterior of the lower portion of the holster, and the lower end of the holster can also be open when the holster is to be used with a flashlight having a clip.

Figure 3:
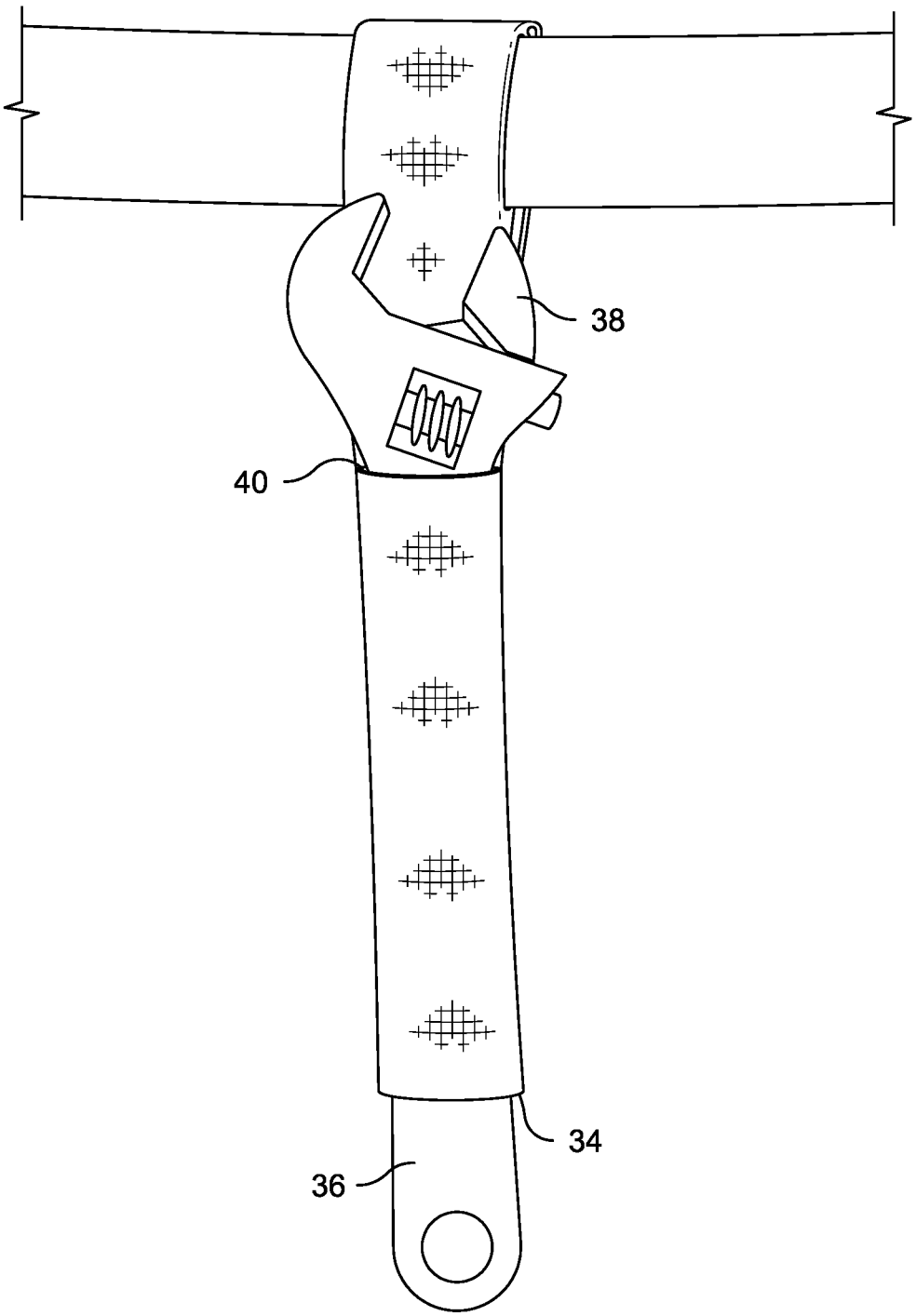
FIG. 3 is a perspective view of a second embodiment of the holster, shown holding an adjustable wrench.

FIG. 3 shows a holster 32 which is similar to holster 10 except that it has an open lower end 34 through which the handle 36 of an adjustable wrench 38 extends. An open lower end enables the holster to accommodate wrenches and other devices having various lengths, but having end portions shaped to engage the margin of the third opening of the holster, i.e., opening 40 in FIG. 3.

Figure 4:
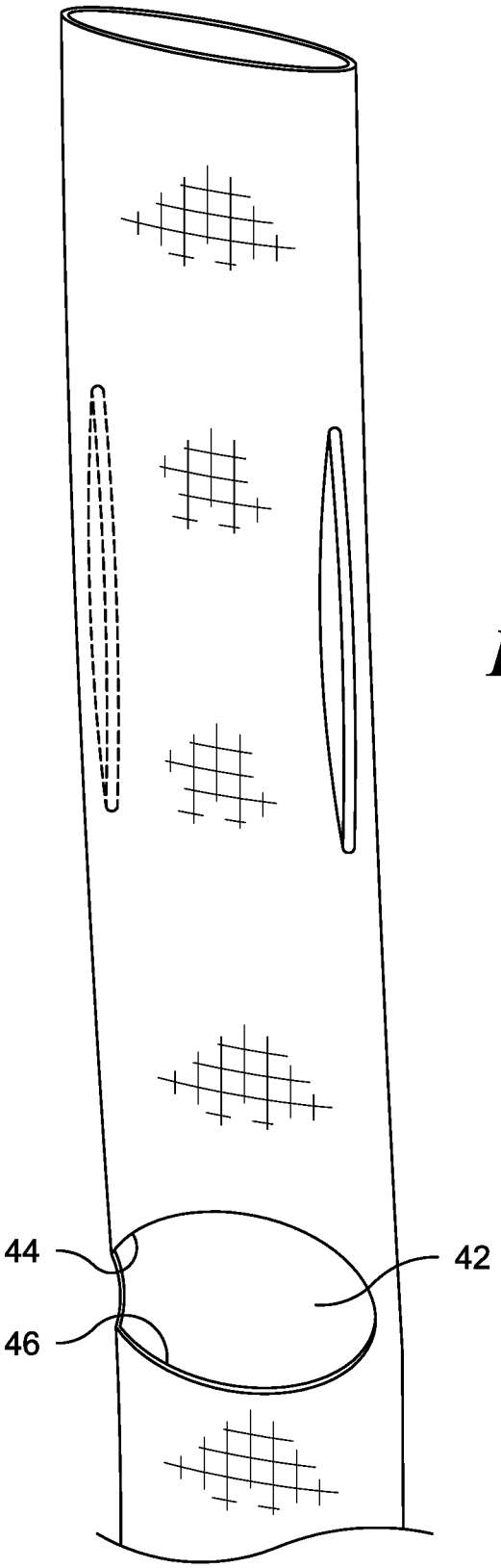
FIG. 4 is a perspective view of a third embodiment of the invention in which the third opening is formed by cutting a circle in the fabric tube.

In the embodiments shown in FIGS. 1-3, the article-receiving opening, i.e., the third opening of the holster, is formed by a straight cut extending in a direction transverse to the direction of elongation of the woven tube. In the modified version of the holster, shown in FIG. 4, the third opening 42 is formed by cutting the fabric tube so that the opening has two opposed concave margins 44 and 46. The opening thus formed facilitates the insertion of an article such as a flashlight, a wrench, or other device into the holster. The opening can be circular, in which case the concave margins will be 180° circular arcs.

The fourth embodiment of the holster, illustrated in FIGS. 5-8, does not utilize elongated longitudinal openings in the wall of the tube, to form a belt loop. Instead, the belt loop is formed by bending the tube on itself. The tube extends from the bend forming the loop, through a transverse opening into the interior of the tube, and then outward through an end opening in the tube. The outward extending portion includes an opening for receiving an elongated article, and serves as a pocket for holding the article.

Figure 5:
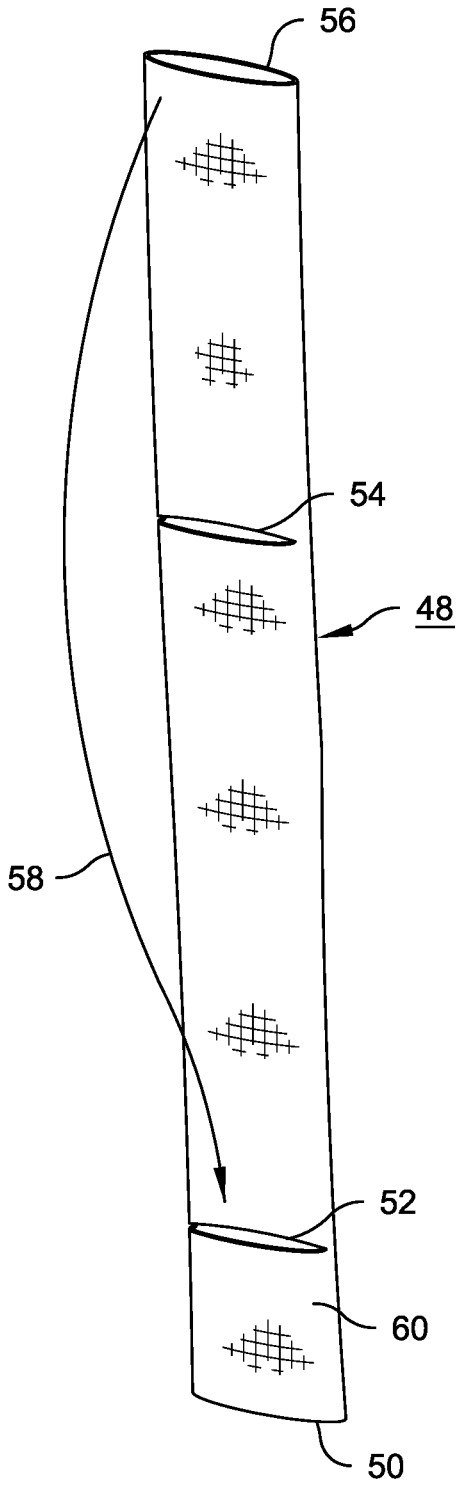
FIG. 5 is a perspective view showing an initial stage in the formation of a holster in accordance with a fourth embodiment of the invention from a length of fabric tubing having two openings, each extending in a direction transverse to the direction of elongation of the tube.

FIG. 5 shows showing an initial stage in the formation of the holster in accordance with the fourth embodiment. It depicts an elongated length of fabric tubing 48 having an open end 50, and two transverse openings 52 and 54, each extending in a direction transverse to the direction of elongation of the tube. The opposite end 56 of the tube can be open or closed depending on the type of article that the holster is intended to accommodate.

Each of the transverse openings should have a length at least approximately equal to the one-half the circumference of the tube. Preferably, the distance from the first transverse opening 52 to the second transverse opening 54 exceeds the distance between open end 50 and transverse opening 52 by a distance at least twice the width of a waist belt for which the holster is intended. Thus, for example, if the distance from the end 50 of the tube to transverse opening 52 is 3 cm, for a belt having a width of 4 cm, the distance between transverse openings 52 and 54 should be at least, and preferably slightly more than, 11 cm.

Figure 6:
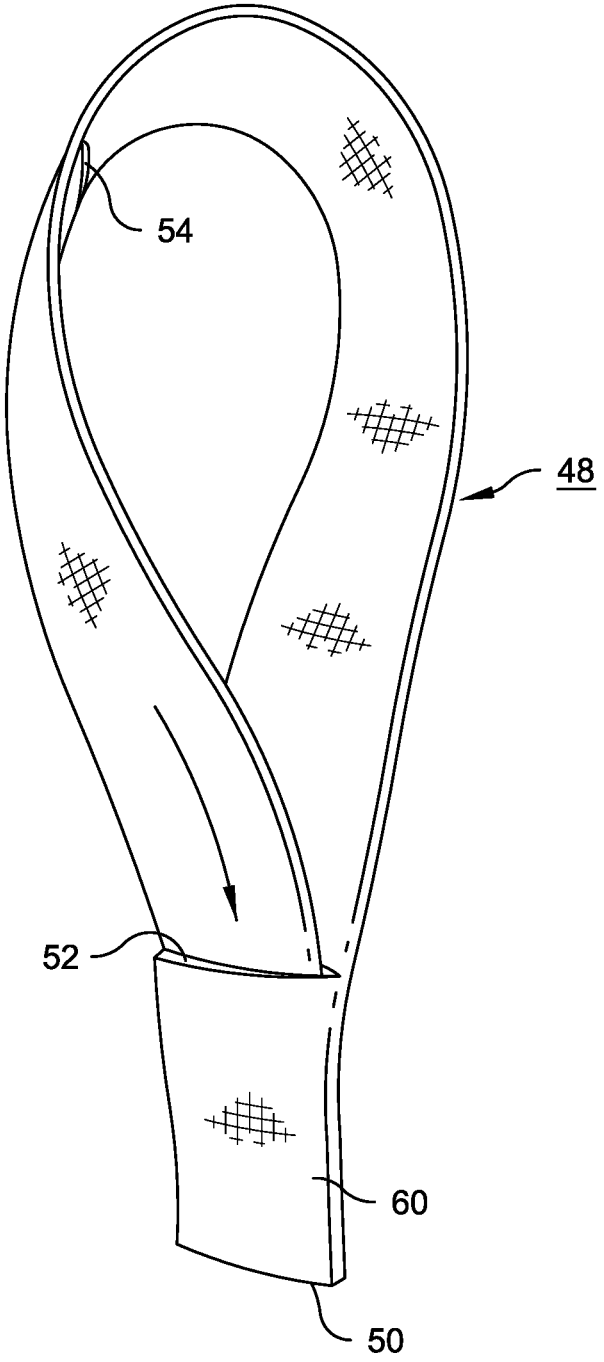
FIG. 6 is a perspective view illustrating a second step in the formation of a holster in accordance with the fourth embodiment.

In the formation of the holster, the tube is bent in the manner depicted by arrow 58 in FIG. 5, and the upper end 56 of the tube is inserted into transverse opening 52, as shown in FIG. 6, and through the portion 60 of the tube that extends from opening 52 to the opening at end 50. The insertion is continued, so that the end 56 (FIG. 5) emerges from the opening at end 50 of the tube and, ultimately, the transverse opening 54 is located below the opening at end 50, as depicted in FIG. 7, which shows the final configuration of the holster.

Figure 7:
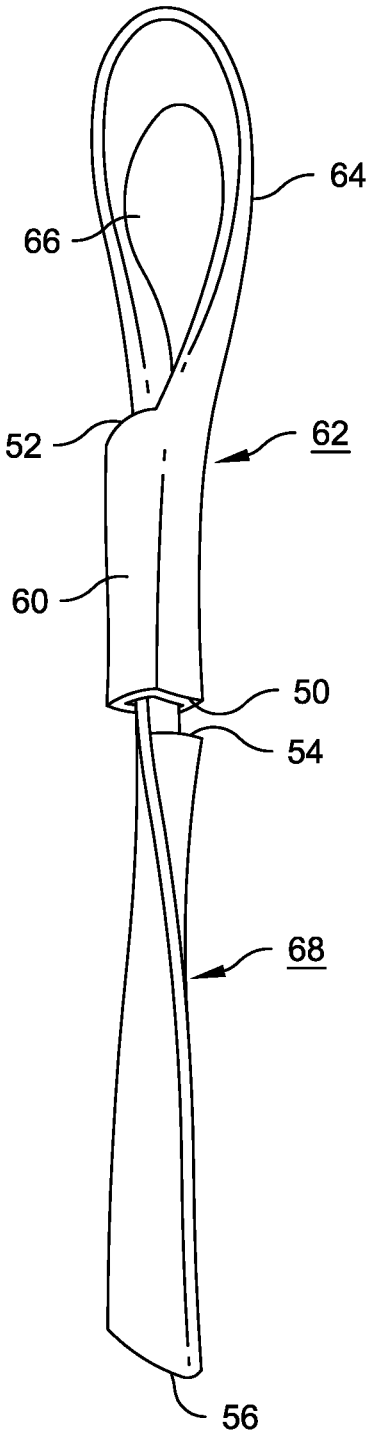
FIG. 7 is a perspective view illustrating the completed holster in accordance with the fourth embodiment.

As shown in FIG. 7, the final version of the holster in accordance with this embodiment comprises a first part 62 of the tube, that includes portion 60 and a loop 64 having a passage 66 though which a waist belt can extend, and a second part 68, extending outward through the open end 50 of portion 60 of the first part 62, and downward from the first part in a direction transverse to the direction in which a belt will extend through belt loop opening 66. Opening 54 in second part 68, which is external to portion 60, will ordinarily be at a location adjacent end 50. Opening 54 provides a passage leading from the exterior of the tube to the interior thereof, enabling the second part 62 to serve as a pocket for receiving and holding an elongated article such as a flashlight, wrench or another tool.

Figure 8:
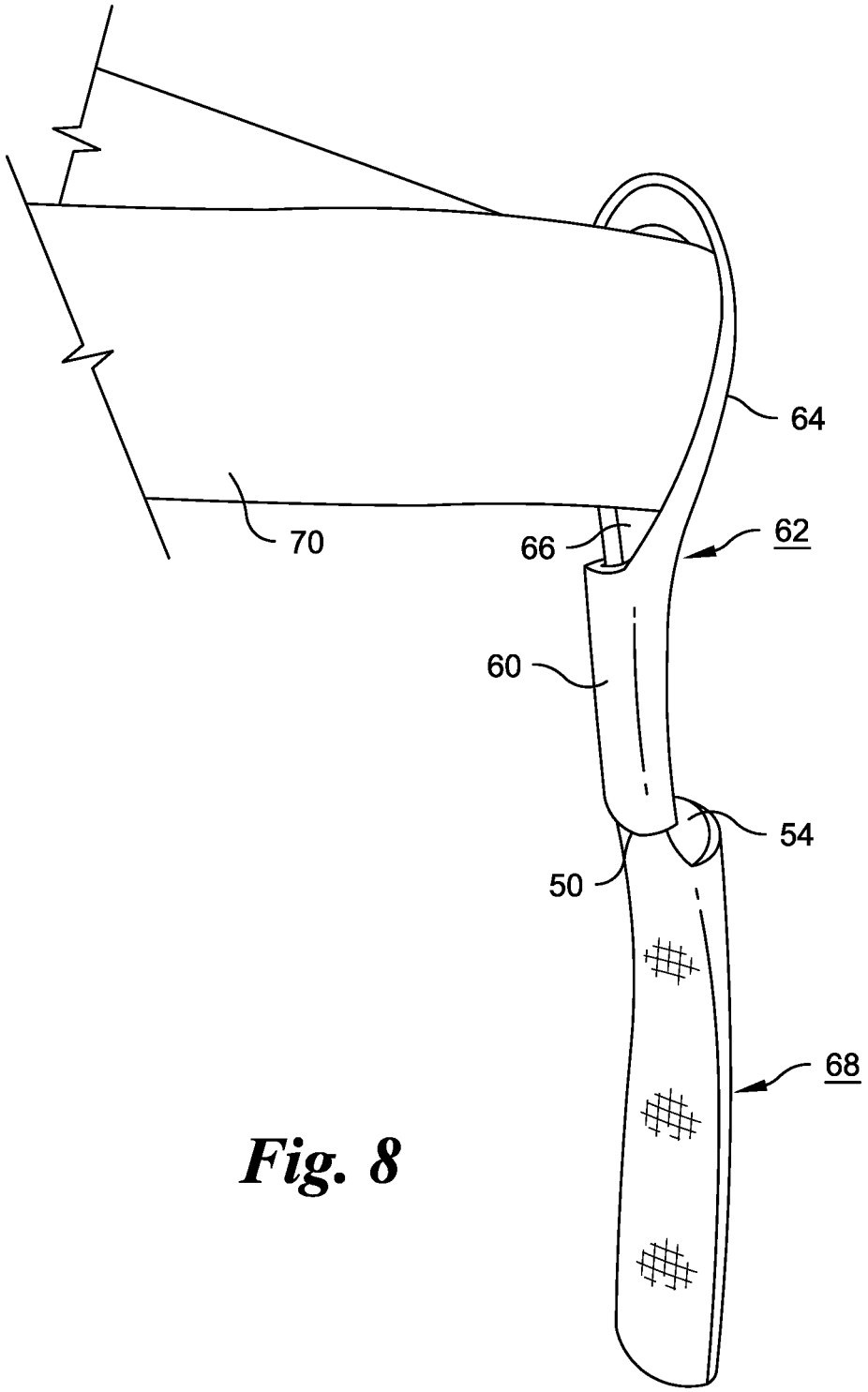
FIG. 8 is a perspective view illustrating the completed holster in accordance with the fourth embodiment attached to a waist belt, and showing the direction in which an article such as a tool or a flashlight is inserted into the pocket of the holster.

FIG. 8 illustrates the holster of FIG. 7 depending from a waist belt 70, which extends through the opening 66 formed by the loop in the first part 62 of the tube.

Optionally, the portion of the tube extending from opening 52 to the opening at end 50 of the tube can allow the part of the tube that extends through this portion to slide so that size of the belt-receiving loop can be adjusted. Alternatively, the parts can be fused together by the application of heat to prevent such sliding.

Various modifications can be made to the holsters described above. For example, the lengths of the first and second openings can be varied, and the relationship between the third opening and the first and second openings can be varied to achieve a desired relationship between the user's waist belt and the article-receiving pocket. Moreover, while the holster can be made inexpensively from available woven fabric tubing having a constant diameter, woven fabric tubes having tapered shapes can be utilized to accommodate various tools and other articles. These and other modifications can be made to the holsters described herein without departing from the scope of the invention as defined in the following claims.

What is claimed is:

1. A holster comprising an elongated tube of fabric having a flexible wall, a first part of the elongated tube providing a passage through which a waist belt can extend in a first direction, a second part of the elongated tube extending from said first part in a second direction transverse to said first direction, and a first opening in said second part providing a passage leading from the exterior of the tube to the interior thereof, said first opening enabling said second part of the tube to serve as a pocket for receiving and holding an elongated article, wherein:

said first part of the elongated tube has an open end and a second opening spaced from said open end, said second opening providing a passage leading from the exterior of the tube to the interior thereof;

said first part of the elongated tube includes a bent Portion of said tube;

a loop, forming said passage through which a waist belt can extend, is constituted in part by said bent portion and extends from a location adjacent said second opening;

the tube extends from said loop into said second opening, through the portion of the tube extending from said second opening to said open end, and outward from said open end; and said second part of the elongated tube is the portion of the tube extending outward from said open end.

2. A holster according to claim 1, wherein said fabric is a woven material composed of fusible yarns.

3. A holster according to claim 1, wherein said fabric is a fabric woven from yarns from the group consisting of nylon and polyester yarns.

4. A holster according to claim 1, wherein said fabric is a woven material composed of fusible yarns, and wherein the yarns at the margins of said first and second openings are fused to one another.

5. A holster according to claim 1, wherein said fabric is a fabric woven from yarns from the group consisting of nylon and polyester yarns, and wherein the yarns at the margins of said first and second openings are fused to one another.

6. A holster comprising an elongated tube of fabric having a flexible wall, a first part of said tube being in the form of a loop having a passage though which a waist belt can extend in a first direction, a second part of said tube extending from said first part in a second direction transverse to said first direction, and a first opening in the wall of the tube in said second part providing a passage leading from the exterior of said tube to the interior thereof, said first opening enabling said second part of the tube to serve as a pocket for receiving and holding an elongated article, said first part of the elongated tube having an open end and a second opening in the wall of said tube spaced from said open end, said second opening providing a passage leading from the exterior of the tube to the interior thereof;

wherein said first part of the elongated tube includes a bent portion of said tube;

wherein said loop includes, and is formed in part by, said bent portion, and extends from a location adjacent said second opening;

wherein the tube extends from said loop into said second opening, through the portion of the tube extending from said second opening to said open end, and outward from said open end;

wherein said second part of the elongated tube is the portion of the tube extending outward from said open end; and wherein said first opening in the wall of the tube in said second part is external to said portion of the tube extending from said second opening to said open end.

* * * * *